US006401932B1

(12) United States Patent
Weinstein et al.

(10) Patent No.: US 6,401,932 B1
(45) Date of Patent: Jun. 11, 2002

(54) HANDLESET PACKAGING WITH INTERACTIVE FEATURE

(75) Inventors: Michael Weinstein; Eric E. Thompson, both of Costa Mesa, CA (US)

(73) Assignee: Emhart LLC, Newark, DE (US)

( * ) Notice: Subject to any disclaimer, the term of this patent is extended or adjusted under 35 U.S.C. 154(b) by 0 days.

(21) Appl. No.: 09/608,858

(22) Filed: Jun. 30, 2000

(51) Int. Cl.[7] ..... B65D 29/54
(52) U.S. Cl. ..... 206/779; 206/320
(58) Field of Search ..... 206/736, 745, 206/749, 752, 756, 759, 762, 763, 764, 765, 769, 320, 779, 469, 471, 576, 580, 232, 372, 373, 467

(56) References Cited

U.S. PATENT DOCUMENTS

| | | | | | |
|---|---|---|---|---|---|
| 4,180,165 | A | * | 12/1979 | Kuchenbecker | 206/461 |
| 4,307,803 | A | | 12/1981 | Johnson | |
| 4,359,182 | A | | 11/1982 | Perkins, Jr. | |
| 4,739,353 | A | * | 4/1988 | Heuer et al. | 206/316.1 |
| D299,114 | S | | 12/1988 | Klinge | |
| 4,930,627 | A | * | 6/1990 | Borst et al. | 206/470 |
| 4,993,623 | A | | 2/1991 | Kelly et al. | |
| D315,095 | S | | 3/1991 | Wright | |
| D315,302 | S | | 3/1991 | Kistler | |
| 5,012,927 | A | * | 5/1991 | Borst | 206/470 |
| D320,469 | S | | 10/1991 | Hoenig | |
| 5,064,056 | A | | 11/1991 | Gresh | |
| D328,248 | S | | 7/1992 | Ruff | |
| 5,129,516 | A | | 7/1992 | Theros | |
| 5,147,035 | A | * | 9/1992 | Hartman | 206/815 |
| 5,188,222 | A | | 2/1993 | Pierce | |
| 5,311,990 | A | * | 5/1994 | Kalinski | 206/370 |
| 5,435,447 | A | | 7/1995 | Weatherford et al. | |
| D367,226 | S | | 2/1996 | Ransbottom | |
| 5,595,300 | A | * | 1/1997 | Paik et al. | 206/449 |
| 5,622,258 | A | | 4/1997 | Baublitz et al. | |
| 5,718,335 | A | | 2/1998 | Bourdreaux | |
| D394,384 | S | | 5/1998 | Humphrey | |
| 5,775,499 | A | * | 7/1998 | Budert | 206/379 |
| 5,816,411 | A | | 10/1998 | Smith | |
| D405,370 | S | | 2/1999 | Humphrey | |
| D406,056 | S | | 2/1999 | Flores et al. | |
| 5,865,013 | A | * | 2/1999 | Jackson | 206/278 |
| D406,528 | S | | 3/1999 | Flores et al. | |
| 5,890,593 | A | | 4/1999 | Humphrey | |
| D414,108 | S | | 9/1999 | Humphrey | |
| 6,216,866 | B1 | * | 4/2001 | Schoenberg | 206/320 |

* cited by examiner

*Primary Examiner*—Shian Luong
(74) *Attorney, Agent, or Firm*—Harness, Dickey & Pierce, P.L.C.

(57) ABSTRACT

An interactive packaging system is disclosed which is particularly suited for a door handleset and provides a potential purchaser with direct visual and tactile access to the product without the need of opening the packaging. Additionally, the packaging system includes a base which provides an increased footprint to stably support the packaging system in an upright position.

22 Claims, 3 Drawing Sheets

HANDLESET PACKAGING WITH INTERACTIVE FEATURE

BACKGROUND AND SUMMARY OF THE INVENTION

The present invention relates generally to packaging for a door handleset and more specifically to an interactive packaging system which affords a potential purchaser both visual and tactile access to the handleset contained therein.

There are many considerations that must be taken into account when developing packaging for products for retail sale. Such factors include the need to attract the potential buyer's attention, the ability for the store owner to be able to conveniently display the product, and the need to contain and protect the product to name but a few. In addition to these considerations, it is very desirable to design packaging which will enable the potential purchaser to handle and operate the product contained therein to obtain both tactile and visual "feel" for the product. Such packaging, commonly referred to as interactive packaging, is also desirable because it affords a closer examination of the product prior to purchase without the need for the potential consumer to vandalize the product in an effort to conduct his examination.

The present invention provides a unique and highly effective solution to the above-noted and often conflicting objectives by providing a packaging system which maximizes purchaser interaction with a handleset by readily permitting operation of the components thereof while also securely protecting and supporting the product therein so as to avoid potential damage during transporting of same. Further, the packaging system provides an adequate base structure to allow the product to be displayed in an upright manner. The packaging system is further adapted to minimize the space requirement such that quantities may be easily packed in large containers for shipping without concern for damage to or loss of included parts or accessories.

Additional advantages and features of the present invention will become apparent from the subsequent description and appended claims taken in conjunction with the accompanying drawings.

DESCRIPTION OF THE PREFERRED EMBODIMENT

Figure 1:
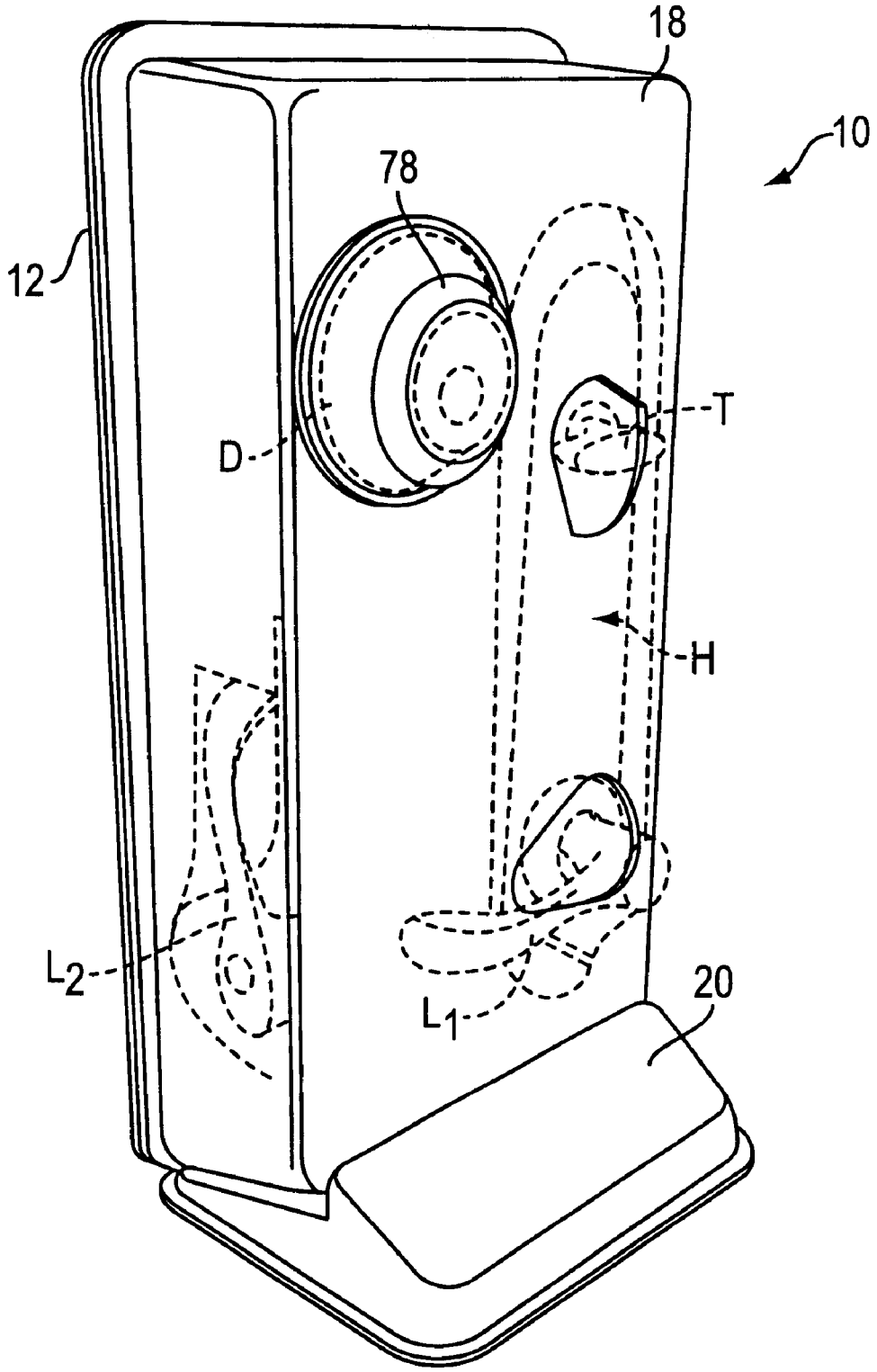
FIG. 1 is a perspective view of the packaging system in accordance with the present invention.

Referring now to the figures, there is shown a packaging system 10 in accordance with the present invention. Packaging system 10 is specifically designed for use in connection with a handleset assembly for a door and affords a potential purchaser thereof both visual and tactile contact. The lever of the handleset may be grasped and rotated, the deadbolt turnpiece may also be operated without the need to open or remove any portion of the product itself. Packaging system 10 includes back 12, tray 14, display cards 16 and cover 18. As presently preferred, back 12 and cover 18 are formed of a transparent thermal plastic. Tray 14 is also formed of a thermal plastic, but need not have a transparent quality. Display cards 16 are formed of a single sheet of suitable paperboard material. The components of packaging system 10 are assembled in a manner such that the door hardware is supported within tray 14 and encased within back 12 and cover 18 with portions of the handleset extending through the cover to provide the interactive feature.

Figure 2:
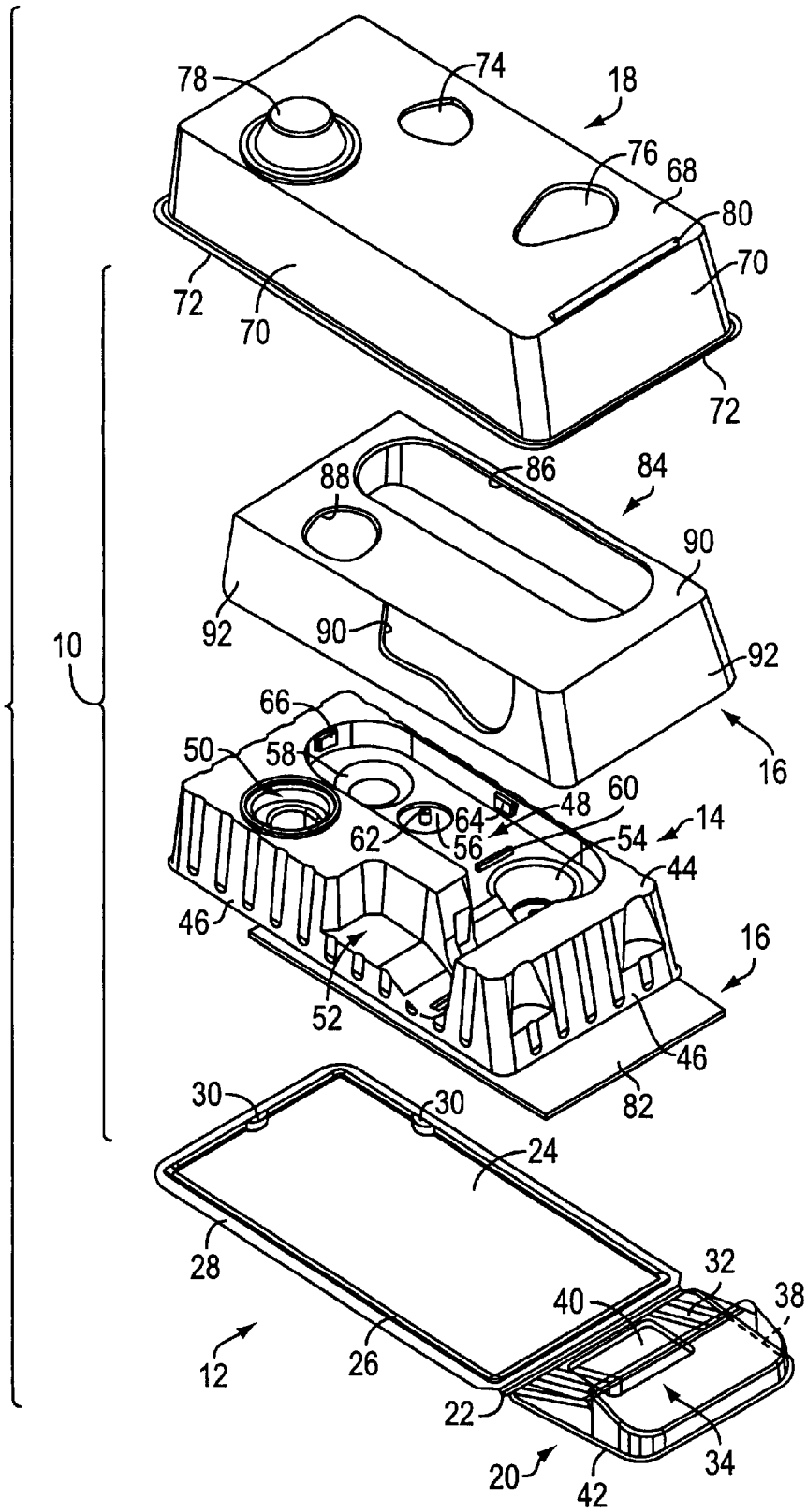
FIG. 2 is an exploded perspective view of the packaging system of FIG. 1.
Figure 3:
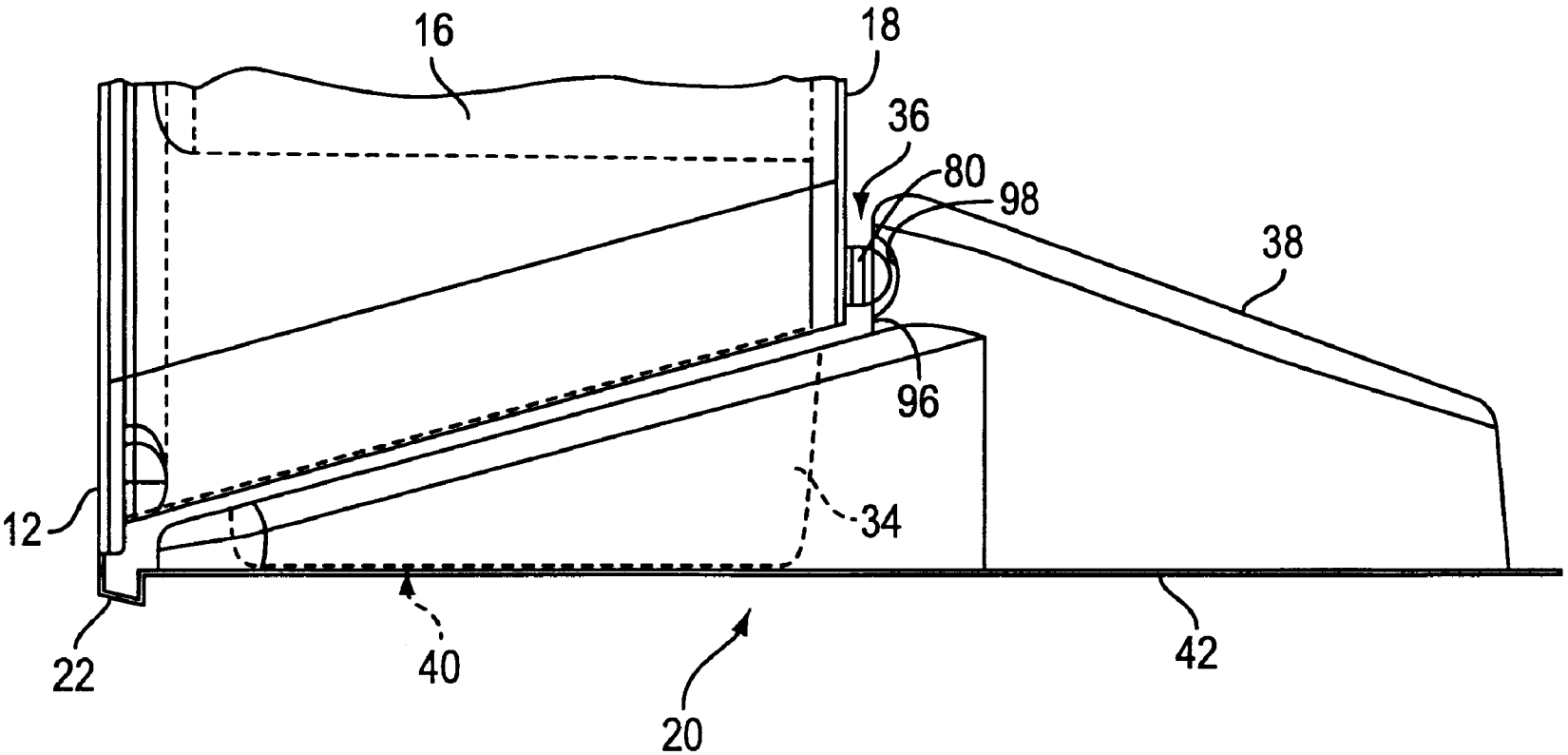
FIG. 3 is a detailed side view of the packaging system of FIG. 1.

Back 12 includes base portion 20 interconnected thereto by way of living hinge 22. As such, base 20 and living hinge 22 are formed as an integral part of back 12. Base 20 is positionable from a generally coplanar position with respect to back 12 as shown in FIG. 2 to a generally perpendicular position with respect to back 12 as shown in FIGS. 1 and 3. In this manner, base 20 provides a suitable base or footprint for adequately supporting packaging system 10 in an upright position. This is particularly advantageous given the substantial weight of the components contained within the packaging and the relatively high center of gravity with respect to base 20.

With specific reference to FIG. 2, back 12 has a substantially planar back panel 24 with bead 26 extending inwardly therefrom to provide a locating feature for the remaining components of packaging system 10. Bead 26 extends around the periphery of back panel 24 to form a closed rectangular configuration. Flange 28 extends outboard of bead 26 and provides surface area for securing back 12 to cover 18. Back 12 further includes locating features 30 formed in back panel 24 adjacent bead 26.

As previously mentioned, base 20 is coupled to back panel 24 at living hinge 22. Base 20 has a supporting surface 32 formed thereon which includes footrest 34, clasp mechanism 36 and display panel 38. As best seen in FIG. 3, footrest 34 extends downwardly from support surface 32 and terminates at sole 40 which is generally planar with outer perimeter 32 of base 20. Display panel 38 provides a generally flat surface for locating various information concerning the products contained within packaging system 10. For example, display panel 38 may be embossed with various indicia of the source of the product or alternately may be provided with advertising copy regarding same.

Tray 14 locates and secures the various components of the handleset H within packaging system 10 and is adequately sized to present these components in a way that simulates an installed condition. For example, as illustrated in FIG. 1, handleset H is positioned in a generally vertical location with the lever $L_1$ situated below the turnpiece T. Deadbolt assembly D is located adjacent to handleset H. A second lever $L_2$ is located in a side pocket such that it is viewable from the side of packaging system 10. While the preferred embodiment illustrates a separate back and tray, one skilled in the art will recognize that these two components could be combined into a single integral back/tray.

With reference again to FIG. 2, tray 14 is generally rectangularly shaped having a top panel 44 and side walls 46 extending downwardly therefrom. Various pockets 48, 50, 52 are formed in top panel 44 and side wall 46 to locate the components of the handleset. For example, pocket 48 is adapted to receive handleset H. Additional reliefs 54, 56, 58 are formed in pocket 48 to provide sufficient clearance for the locking mechanisms which extend rearwardly from the base plate for handleset H. Locating features 60, 62 may also be formed in pocket 48 for appropriately positioning handleset H therein. Tabs 64, 66 extend from the side wall of pocket 48 and provide means for releasably securing the handieset H therein. Pocket 50 is similar to pocket 48 and may be adapted to include various reliefs, locating features and tabs as heretofore described. Pocket 52 represents a relief formed in side wall 46 which is sized and configured to locate an additional components of handleset H such as lever $L_2$.

Cover 18 has a generally rectangular shape which is complementary with and fits over tray 16. Cover 18 has a top panel 68 and side walls 70 extending downwardly therefrom. Side walls 70 terminate at flange 72 which provides a surface for interconnecting back 12 with cover 18. Top panel 68 has various cut-outs or openings 74, 76 formed therein which permit the components of handleset H to extend through cover 18 and be accessible for operation by a prospective purchaser. In a preferred embodiment, cut-out 74 has a generally bell-shaped configuration, and cut-out 76 has a tear drop or egg-shaped configuration. It has been found that these configurations facilitate assembly of packaging system 10 by providing adequate clearance for inserting turnpiece T and lever $L_1$ through cut-outs 74, 76, respectively. Cover 18 further has window 78 which extends outwardly from top panel 68 for enclosing a component such as deadbolt D within packaging system 10. As illustrated in FIG. 2, window 78 has a generally frusto-conical configuration. However, one skilled in the art will readily recognize that cover 18 may be provided with windows having other configurations depending upon the specific component encased therein. Bead 80 is formed along a lower edge of cover 18 and cooperates with clasp mechanism 36 formed on back 12 as hereinafter described.

Packaging system 10 may include various display cards 16 including rear display card 82 and front display card 84. Rear display card 82 is a generally flat member which is interdisposed between back panel 24 and tray 14. Rear display card 82 provides a dual function of concealing the bottom portion of tray 14 while providing a surface area upon which various copy can be included concerning the product contained within packaging system 10. Front display card 84 is configured in a manner to overlay tray 14 to cover up various portions of top panel 44 and side walls 46 while at the same time allowing portions of handleset H to appear therethrough. In this regard, cut-outs 86, 88 are formed in top panel 90, and cut-out 92 is formed in side wall 92. As with rear display card 82, front display card 84 further provides substantial surface area upon which various graphics and copy may be placed concerning the components contained within packaging system 10.

With particular reference to FIG. 3, packaging system 10 further includes a clasp mechanism 36 which allows base 20 to be releasably secured in a position which is generally perpendicular to back panel 24. Base 20 has a vertical wall portion 96 which extends generally parallel to top panel 68 of cover 18 when base 20 is in the perpendicular or use position. Relief 98 is formed in vertical wall 96 and is adapted to engage bead 80 such that base 20 is releasably secured in the use position.

With reference now to the drawings, a general description of the assembly of packaging system 10 will be provided. Initially, tray 14 is loaded with the various components to be included within packaging system 10. Display card 84 is positioned over tray 14 and cover 18 is positioned over display card 84 and tray 14 such that the desired components of handleset H extend through cut-outs 74, 76. Next, display card 82 is loaded into back 12. At this point tray 14 and cover 18 are positioned onto back 12 such that side walls 46 of tray 14 are interdisposed between side walls 70 of cover 18 and bead 26 of back 12. Flange 28 of back 12 and flange 72 of cover 18 are secured together utilizing a suitable binding method such as adhesive or thermal binding.

Base 20 remains substantially coplanar with back panel 24 in an extended position. At this point, base 20 may now be rotated upwardly about living hinge 22 such that vertical wall 96 is positioned adjacent to top panel 68. Bead 80 engages vertical wall 96 and passes into relief 98 such that base 20 is releasably secured in the perpendicular position. Clasp mechanism 36 is such that base 20 may be repeatedly positioned between the extended position illustrated in FIG. 2 and the perpendicular position illustrated in FIG. 3.

The present invention has been described with particular reference to a preferred embodiment in which packaging system 10 is adapted for a door handleset having a lever and a turnpiece extending through apertures providing an interactive feature. However, one skilled in the art will readily recognize that the packaging system of the present invention may be further modified or adapted for packaging various other door hardware components such as door knobs, door slides and deadbolts by way of example. Furthermore, while the preferred embodiment includes a back having a back panel and base portion interconnected by a living hinge, one skilled in the art will readily recognize that the living hinge, while preferred, is not an essential feature to the present invention and that other means for interconnecting these components such as adhesive or tape are equally applicable in this application.

While it will be apparent that the preferred embodiments of the invention as disclosed are well calculated to provide the advantages and features above-stated, it will be appreciated that the invention is susceptible to modification, variation and changes without departing from the proper scope of fair meaning of the subjoined claims.

What is claimed:

1. An interactive packaging system for door hardware products comprising:

a back including a panel member;

a tray having an upper surface, a pocket formed in said upper surface and a side wall extending downwardly away from said upper surface, said tray being located on said panel member;

a cover having a top panel with a cut-out formed therein and a side wall extending downwardly away from said top panel, said cover being disposed over said tray and secured to said panel member such that said cut-out is adaptable to permit access to at least a portion of a door hardware product located in said pocket; and a base hingedly coupled to said back and positionable between a first position wherein said base is generally co-planar to said back and a second position wherein said base is generally perpendicular to said upper surface of said tray such that the packaging system may be displayed in a vertical upright position.

2. The interactive packaging system of claim 1 wherein said base has a peripheral edge and a foot extending downwardly from the base terminating at a sole, said peripheral edge and said sole being generally co-planar.

3. The interactive packaging system of claim 1 wherein a living hinge is formed between said back and said base.

4. The interactive packaging system of claim 1 further comprising a clasping mechanism interdisposed between said base and said cover for releasable securing said base in said second position.

5. The interactive packaging system of claim 4 wherein said clasping mechanism comprises a bead formed on said cover which is adapted to engage a relief formed in said base.

6. The interactive packaging system of claim 1 wherein said base has a display panel formed therein.

7. The interactive packaging system of claim 1 further comprising a window extending outwardly from said top panel.

8. The interactive packaging system of claim 7 wherein said tray has a second pocket formed adjacent said window.

9. The interactive packaging system of claim 1 wherein said tray has a second pocket formed in said side wall of said tray and is adapted to hold a door hardware product which is viewable through said side wall of said cover.

10. The interactive packaging system of claim 1 wherein said tray has a locating feature formed therein which extends into said pocket, said locating feature being adapted to position a door hardware product located in said pocket.

11. The interactive packaging system of claim 1 wherein said tray has a tab formed therein which extends into said pocket, said tab being adapted to retain a door hardware product located in said pocket.

12. The interactive packaging system of claim 1 further comprising a display card interdisposed between said upper surface of said tray and said top panel of said cover.

13. The interactive packaging system of claim 12 wherein said display card includes a first portion interdisposed between said upper surface of said tray and said top panel of said cover and a second portion interdisposed between said side wall of said tray and said side wall of said cover.

14. The interactive packaging system of claim 1 further comprising a display card interdisposed between said tray and said back panel.

15. The interactive packaging system of claim 1 wherein said panel member has a first flange formed thereon and said cover has a second flange formed thereon, said first and second flanges being secured together.

16. The interactive packaging system of claim 1 wherein said panel member has a bead formed therein for locating said tray on said back.

17. In combination, a door hardware product and an interactive packaging system comprising:

a door hardware component having a operating member; and an interactive packaging system including:

a back having a panel member;

a tray having an upper surface, a pocket formed in said upper surface and a side wall extending downwardly away from said upper surface, said tray being located on said panel member and said door hardware component being located within said pocket;

a cover having a top panel with a cut-out formed therein and a side wall extending downwardly away from said top panel, said cover being disposed over said tray and secured to said panel member such that said operating member extends through said cut-out; and a base hingedly coupled to said back and positionable between a first position wherein said base is generally co-planar to said back and a second position wherein said base is generally perpendicular to said upper surface of said tray such that the packaging system may be displayed in a vertical upright position.

18. The combination of claim 17 wherein said door hardware component has a first operating member and a second operating member, and said cover has a first cut-out and a second cut-out formed therein, said cover being disposed over said tray such that said first operating member extends through said first cut-out and said second operating member extends through said second cut-out.

19. The combination of claim 17 further comprising:

a second pocket formed in said upper surface;

a window formed in said cover adjacent said second pocket;

a second door hardware component located in said second pocket and extending into said window.

20. The combination of claim 17 wherein said tray has a second pocket formed in said side wall of said tray and is adapted to hold a second door hardware component which is viewable through said side wall of said cover.

21. The combination of claim 17 further comprising a clasping mechanism interdisposed between said base and said cover for releasable securing said base in said second position, said clasping mechanism including a bead formed on said cover which is adapted to engage a relief formed in said base.

22. In combination a door hardware product and an interactive packaging system comprising:

a door hardware product including a first hardware component having a first operating member and a second operating member, a second hardware component, and a third hardware component; and an interactive packaging system including:

a back including a panel member;

a tray having an upper surface, a side wall extending downwardly away from said upper surface, a first pocket formed in said upper surface to receive said first hardware component, a second pocket formed in said upper surface to receive said second hardware component and a third pocket formed in said side wall to receive said third hardware component, said tray being located on said panel member;

a cover disposed over said tray and secured to said panel member, said cover having a top panel with a first cut-out and a second cut-out formed therein formed therein such that said first and second operating members extend through said first and second cut-outs, a window extending outwardly from said top panel and located adjacent said second pocket such that a portion of said second hardware component is viewable through said window and a side wall extending downwardly away from said top panel such that a portion of said third hardware component is viewable through said side wall a base hingedly coupled to said back and positionable between a first position wherein said base is generally co-planar to said back and a second position wherein said base is generally perpendicular to said upper surface of said tray such that the packaging system may be displayed in a vertical upright position, said base having a peripheral edge and a foot extending downwardly from the base terminating at a sole, said peripheral edge and said sole being generally co-planar; and a clasping mechanism interdisposed between said base and said cover for releasable securing said base in said second position, said clasping mechanism including a bead formed on said cover which is adapted to engage a relief formed in said base.

* * * * *